US010519823B2

(12) United States Patent
Doo et al.

(10) Patent No.: US 10,519,823 B2
(45) Date of Patent: Dec. 31, 2019

(54) ASSEMBLING APPARATUS FOR OIL PUMP

(71) Applicants: Hyundai Motor Company, Seoul (KR); Kia Motors Corporation, Seoul (KR)

(72) Inventors: Jae Kyun Doo, Seoul (KR); Si Hyuk Ryu, Seongnam-si (KR); Se Eun Kim, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 229 days.

(21) Appl. No.: 15/638,826

(22) Filed: Jun. 30, 2017

(65) Prior Publication Data

US 2018/0156083 A1 Jun. 7, 2018

(30) Foreign Application Priority Data

Dec. 6, 2016 (KR) ..... 10-2016-0165155

(51) Int. Cl.

| | |
|---|---|
| ***F01M 1/02*** | (2006.01) |
| ***F04B 23/02*** | (2006.01) |
| ***F04B 53/22*** | (2006.01) |
| ***F01M 11/04*** | (2006.01) |
| ***F04B 53/16*** | (2006.01) |

(Continued)

(52) U.S. Cl.

CPC ..... *F01M 1/02* (2013.01); *F01M 11/0408* (2013.01); *F04B 23/021* (2013.01); *F04B 39/14* (2013.01); *F04B 53/16* (2013.01); *F04B 53/22* (2013.01); *F01M 2011/0079* (2013.01); *F01M 2011/035* (2013.01)

(58) Field of Classification Search

CPC ..... F04B 23/023; F04B 23/021; F04B 23/02; F04B 23/025; F04B 23/026; F04B 53/22; F04B 53/16; F04B 39/14; F04D 13/16; F04D 29/406; F04D 29/60; F04D 29/605; F04D 29/606; F01M 2011/035; F01M 1/02; F01M 2001/0207–0292; F01M 2011/0037; F01M 2011/0066; F01M 2011/0079; F01M 2001/0284; F01M 11/0004; F01M 11/0008

See application file for complete search history.

(56) References Cited

U.S. PATENT DOCUMENTS 3,398,866 A * 8/1968 La Flame ..... A47L 15/4225 134/188
5,181,838 A * 1/1993 Sato ..... B60S 1/481 417/360

(Continued)

FOREIGN PATENT DOCUMENTS

KR 2000-0067484 A 11/2000

*Primary Examiner* — Bryan M Lettman
(74) *Attorney, Agent, or Firm* — Morgan, Lewis & Bockius LLP

(57) ABSTRACT

An assembling apparatus may include an oil pump provided in an oil pan, a partition wall, and a shock absorbing member. The partition wall divides an internal space of the oil pan and is formed to partially surround an external surface of the oil pump, so as to support the oil pump. The shock absorbing member is disposed between an external surface of the oil pump and the partition wall to be in contact therewith. In this structure, the assembling apparatus may mitigate noise and vibration of the oil pump that is built in the oil pan.

7 Claims, 4 Drawing Sheets

(51) Int. Cl.

| | |
|---|---|
| ***F04B 39/14*** | (2006.01) |
| *F01M 11/00* | (2006.01) |
| *F01M 11/03* | (2006.01) |

(56) References Cited

U.S. PATENT DOCUMENTS

| | | | | |
|---|---|---|---|---|
| 2002/0172606 | A1* | 11/2002 | Asano | F01M 1/02<br>417/364 |
| 2010/0012075 | A1* | 1/2010 | Bluhm | F01M 1/02<br>123/196 R |
| 2012/0138011 | A1* | 6/2012 | MacCarrone | F01C 21/10<br>123/196 R |
| 2016/0258507 | A1* | 9/2016 | Onigata | F01M 1/02 |

* cited by examiner

ASSEMBLING APPARATUS FOR OIL PUMP

CROSS REFERENCE TO RELATED APPLICATION

The present application claims priority of Korean Patent Application No. 10-2016-0165155 filed on Dec. 6, 2016, the entire contents of which is incorporated herein for all purposes by this reference.

BACKGROUND OF THE INVENTION

Field of the Invention

The present invention relates to an assembling apparatus for an oil pump, intended to mitigate noise and vibration of an oil pump that is built in an oil pan.

Description of Related Art

A lubrication system forcibly sends oil of an engine to a desired part to lubricate the part, and includes an oil pan that stores oil therein, an oil filter that filters the oil, and an oil pump that sends the oil to respective parts of the engine.

That is, the oil contained in the oil pan may be pumped by the oil pump to be delivered to the oil filter, and the oil filtered by the oil filter may be supplied to respective parts for operating the engine.

Meanwhile, an installation position of the oil pump may be determined depending on an oil lubricating type. For example, in the case of a dry sump type, the oil pump may be installed inside the oil pan.

In this case, since bubbles or air as well as oil may be taken in during an oil intake process, a structure for preventing the oil from being mixed with the air is required. Particularly, it is necessary to prevent vibration generated while the oil pump is driven from being transmitted to the oil pan.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an assembling apparatus for an oil pump, intended to mitigate noise and vibration of an oil pump that is built in an oil pan.

According to one aspect, there is provided an assembling apparatus for an oil pump including an oil pump provided in an oil pan; a partition wall partitioning an internal space of the oil pan, and formed to partially surround an external surface of the oil pump and support the oil pump; and a shock absorbing member disposed between an external surface of the oil pump and the partition wall to be in close contact therewith.

A seating groove may be formed in a center portion of an upper end portion of the partition wall to be concave downwards, and a seating protrusion may be formed on the external surface surrounding a lower end portion of a rotation shaft of the oil pump to be convex downwards, so that the seating protrusion may be seated in the seating groove.

A first surface of the shock absorbing member may be in close contact with an upper surface of the seating groove, and a second surface of the shock absorbing member may be in close contact with a lower surface of the seating protrusion.

The oil pump and the shock absorbing member may be assembled with each other by an assembly structure such that the oil pump and the shock absorbing member correspond to each other and fit into each other.

The assembly structure may include a hole and a protrusion that may be formed on the oil pump and the shock absorbing member, respectively.

The hole may include a first assembly hole formed in each of opposite end portions of the seating protrusion, the first assembly hole being open on a side thereof, and a second assembly hole formed in a center portion of the seating protrusion. The protrusion may include a first assembly protrusion each formed in a hook shape on each of opposite end portions of the shock absorbing member, the first assembly protrusion being fitted into an open portion of the corresponding first assembly hole, and a second assembly protrusion formed on a center portion of the shock absorbing member and fitted into the second assembly hole.

The shock absorbing member may be formed of an elastic material.

A drive gear device coupled to the rotation shaft of the oil pump may be disposed between the partition wall and an internal wall of the oil pan.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
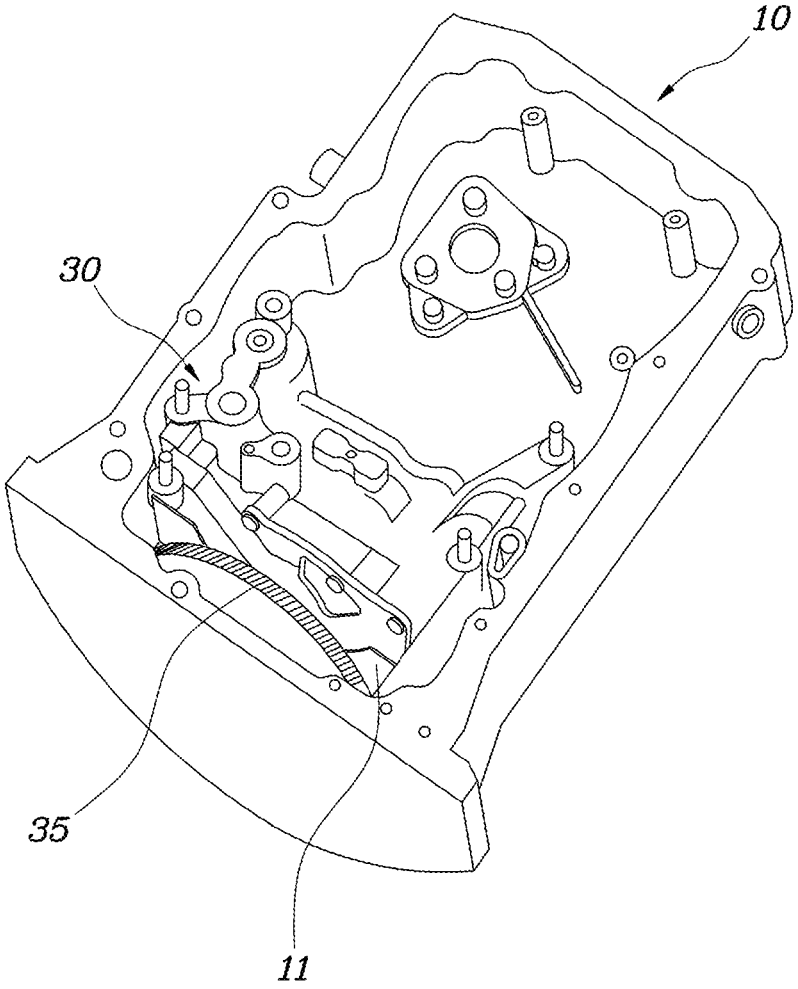
FIG. 1 is a perspective view illustrating the shape of an oil pump disposed in an oil pan, according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is intended to cover not only the exemplary embodiments, but also various alternatives, modifications, equivalents and other embodiments, which may be included within the spirit and scope of the invention as defined by the appended claims.

Hereinbelow, an exemplary embodiment of the present invention will be described in detail with reference to the accompanying drawings.

An assembling apparatus for an oil pump according to an exemplary embodiment of the present invention may mainly include an oil pump 30, a partition wall 11, and a shock absorbing member 20.

Referring to FIGS. 1 to 4, the oil pump 30 may be provided in an oil pan 10.

The partition wall 11 is provided on a bottom surface of the oil pan 10 to partition an internal space of the oil pan 10. The partition wall 11 is formed to partially surround an external surface of the oil pump 30, and is configured to support the oil pump 30.

Furthermore, the shock absorbing member 20 for sealing and absorbing vibration may be disposed between the external surface of the oil pump 30 and the partition wall 11 to be in close contact therewith.

In this regard, the external surface of the oil pump 30 may be a housing of the oil pump, which is shaped to surround a rotation shaft 31 of the oil pump 30. Further, the partition wall 11 may be formed near to an internal wall of a side of the oil pan 10. An interval between the partition wall 11 and the internal wall of the oil pan 10 may be sufficient, as long as it is possible to dispose a drive gear device 35 coupled to the rotation shaft 31 therein.

That is, according to the above-described configuration, an upper surface of the partition wall 11 on which the oil pump 30 is seated is formed to correspond to the external surface of the oil pump 30, thus securing a seating surface of the oil pump 30 and stably supporting the oil pump 30. The shock absorbing member 20 is disposed between the oil pump 30 and the partition wall 11, so that noise and vibration generated while the oil pump 30 is driven are absorbed by the shock absorbing member 20. Therefore, the noise, vibration and harshness (NVH) of the oil pump 30 is mitigated, the vibration of the oil pump 30 is prevented from being transmitted to the oil pan 10, and sealing is maintained between the oil pump 30 and the partition wall 11.

Figure 3:
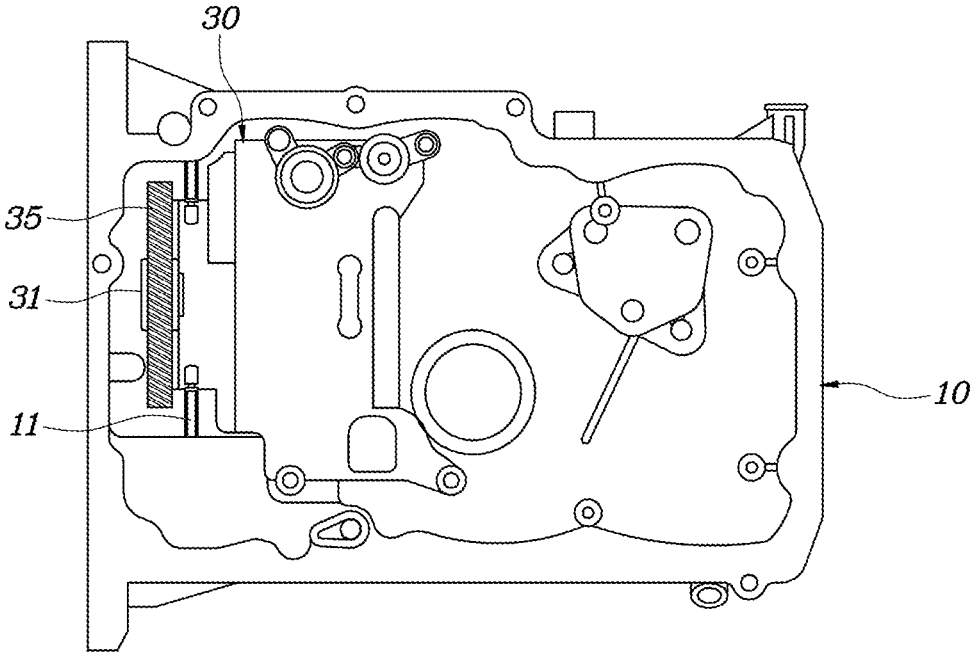
FIG. 3 is a view illustrating the oil pan of FIG. 1 when seen from above.

Moreover, as illustrated in FIG. 3, the drive gear device 35 is disposed in a predetermined space partitioned by the partition wall 11, thus preventing oil stored in a remaining space of the oil pan 10 from being mixed with bubbles even when the bubbles are produced by the rotation of the drive gear device 35, and consequently preventing bubbles or air from being simultaneously taken in during an oil intake process.

Figure 2:
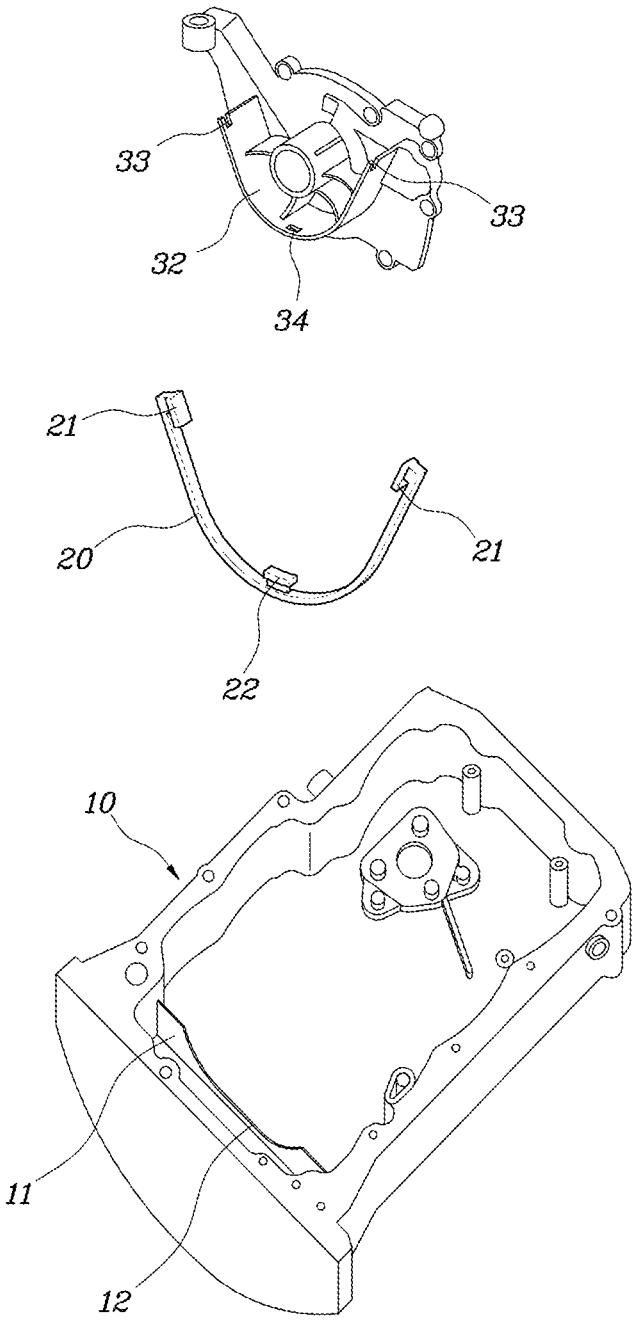
FIG. 2 is an exploded view illustrating the shapes of a shock absorbing member and an oil pump to be mounted on a partition wall in the oil pan, according to an exemplary embodiment of the present invention.
Figure 4:
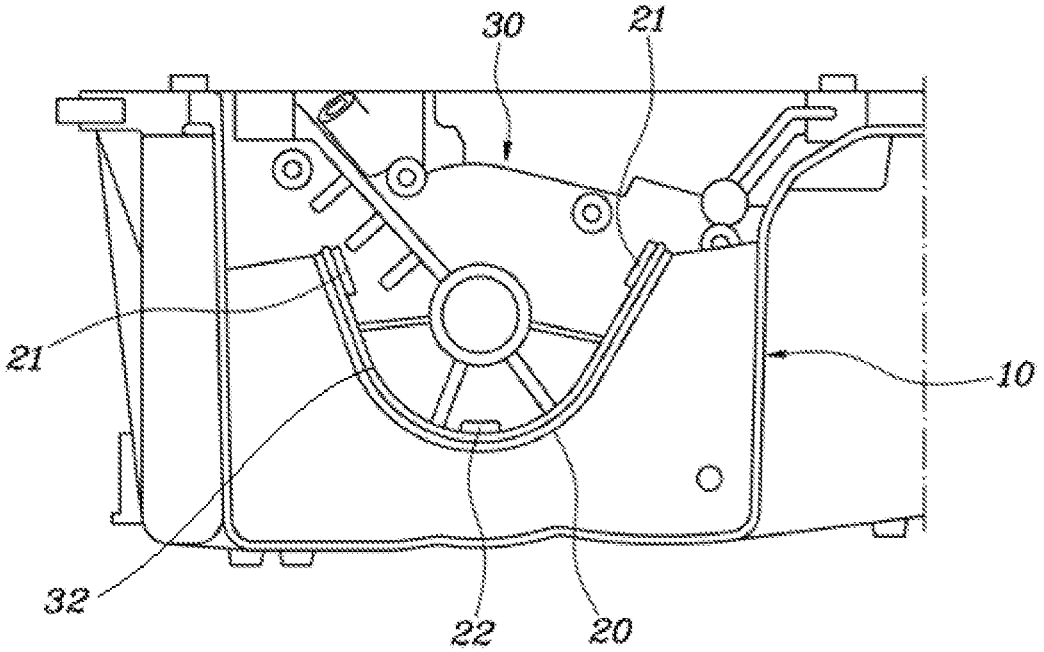
FIG. 4 is a view illustrating a structure in which the shock absorbing member and the oil pump are mounted on the partition wall according to an exemplary embodiment of the present invention.

A structure for securing the seating surface of the oil pump 30 will be described in detail with reference to FIGS. 2 and 4. A seating groove 12 may be formed in a center portion of an upper end portion of the partition wall 11 to be concave downwards.

Furthermore, a seating protrusion 32 may be formed on the external surface surrounding the lower end portion of the rotation shaft 31 of the oil pump 30 to be convex downwards.

That is, the seating groove 12 formed on the partition wall 11 and the seating protrusion 32 formed on the oil pump 30 are formed in shapes that correspond to each other, thus allowing the seating protrusion 32 to be inserted and seated in the seating groove 12.

Thus, the seating surface of the oil pump 30 is stably secured, thus allowing the oil pump 30 to be stably disposed, and the oil pump 30 is assembled in a vertical direction of the oil pan 10, thus making it convenient to assemble the oil pump 30.

Since the shock absorbing member 20 is disposed between the oil pump 30 and the partition wall 11, a lower surface of the shock absorbing member 20 may be in close contact with an upper surface of the seating groove 12, and an upper surface of the shock absorbing member 20 may be in close contact with a lower surface of the seating protrusion 32.

The shock absorbing member 20 disposed in this way is formed of an elastic material including rubber, so that noise and vibration generated by the driving of the oil pump 30 may be more reliably absorbed and reduced.

In addition, the oil pump 30 and the shock absorbing member 20 of the present invention may be assembled with each other by an assembly structure including members that correspond to each other to be fitted relative to each other.

For example, the assembly structure may include a hole and a protrusion that are formed on the external surface of the oil pump 30 and the shock absorbing member 20, respectively.

This will be described in detail with reference to FIGS. 2 and 4. The hole includes first assembly holes 33 and a second assembly hole 34. The first assembly holes 33 may be formed in opposite end portions of the seating protrusion 32 such that each hole is open at a side thereof. The second assembly hole 34 may be formed in a center portion of the seating protrusion 32.

Furthermore, the protrusion includes first assembly protrusions 21 and a second assembly protrusion 22. The first assembly protrusions 21 are formed in the shape of hooks on opposite end portions of the shock absorbing member 20 to be fitted into the open portions of the first assembly holes 33, while the second assembly protrusion 22 is formed on the center portion of the shock absorbing member 20 to be fitted into the second assembly hole 34.

In this regard, sectional areas of first end portions of the first and second assembly protrusions 21 and 22 fitted into the first and second assembly holes 33 and 34 are formed to correspond to sectional areas of the first and second assembly holes 33 and 34, so that the first and second assembly protrusions 21 and 22 may be stably fitted into the first and second assembly holes 33 and 34.

However, sectional areas of second end portions of the first and second assembly protrusions 21 and 22 passing through the first and second assembly holes 33 and 34 to protrude out are formed to be larger than sectional areas of the first and second assembly holes 33 and 34, thus preventing the first and second assembly protrusions 21 and 22 from being removed from the first and second assembly holes 33 and 34.

That is, the first assembly holes 33 are formed, respectively, in the first and second end portions of the seating protrusion 32, and the first assembly protrusions 21 are formed, respectively, on the first and second end portions of the shock absorbing member 20, so that opposite end portions of the shock absorbing member 20 may be assembled with opposite end portions of the seating protrusions 32.

The second assembly hole 34 is formed in the center portion of the seating protrusion 32, and the second assembly protrusion 22 is formed on the center portion of the shock absorbing member 20, so that the center portion of the shock absorbing member 20 may be assembled with the center portion of the seating protrusion 32.

As described above, according to an exemplary embodiment of the present invention, the partition wall 11 provided in the oil pan 10 is formed to correspond to the external surface of the oil pump 30, so that the seating surface of the oil pump 30 is secured and the oil pump 30 is stably supported, and the shock absorbing member 20 is disposed between the oil pump 30 and the partition wall 11, so that noise and vibration generated while the oil pump 30 is driving are absorbed by the shock absorbing member 20, thus improving the noise, vibration and harshness (NVH) of the oil pump 30, preventing the vibration of the oil pump 30 from being transmitted to the oil pan 10, and maintaining sealing between the oil pump 30 and the partition wall 11.

Various aspects of the present invention are directed to providing an assembling apparatus for an oil pump, in which a partition wall provided in an oil pan is formed to correspond to an external surface of the oil pump, thus securing a seating surface of the oil pump and consequently stably supporting the oil pump.

Moreover, Various aspects of the present invention are directed to providing an assembling apparatus for an oil pump, in which a shock absorbing member is disposed between an oil pump and a partition wall, thus allowing noise and vibration generated while the oil pump is driven to be absorbed by a shock absorbing member, and consequently improving the NVH performance of the oil pump and preventing the vibration of the oil pump from being transmitted to an oil pan.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An assembling apparatus for an oil pump comprising:

the oil pump provided in an oil pan;

a partition wall partitioning an internal space of the oil pan, and formed to partially surround an external surface of the oil pump and support the oil pump; and a shock absorbing member disposed between an external surface of the oil pump and the partition wall to be in contact therewith, wherein a seating qroove a formed in a center portion of an upper end portion of the partition wall to be concave downwards, and wherein a seating protrusion is formed on the external surface surrounding a lower end portion of a rotation shaft of the oil pump to be convex downwards, wherein the seating protrusion is configured to be seated in the seating groove.

2. The assembling apparatus according to claim 1, wherein a first surface of the shock absorbing member is in contact with an upper surface of the seating groove, and a second surface of the shock absorbing member is in contact with a lower surface of the seating protrusion.

3. The assembling apparatus according to claim 1, wherein the oil pump and the shock absorbing member are assembled with each other by an assembly structure, and wherein the oil pump and the shock absorbing member correspond to each other and fit into each other.

4. The assembling apparatus according to claim 3, wherein the assembly structure includes a hole and a protrusion that are formed on the oil pump and the shock absorbing member, respectively.

5. The assembling apparatus according to claim 4, wherein the hole includes a first assembly hole formed in each of opposite end portions of the seating protrusion, the first assembly hole being open on a side thereof; and a second assembly hole formed in a center portion of the seating protrusion, and wherein the protrusion includes a first assembly protrusion each formed in a hook shape on each of opposite end portions of the shock absorbing member, the first assembly protrusion being fitted into an open portion of a corresponding first assembly hole, and a second assembly protrusion formed on a center portion of the shock absorbing member and fitted into the second assembly hole.

6. The assembling apparatus according to claim 1, wherein the shock absorbing member is formed of an elastic material.

7. The assembling apparatus according to claim 1, wherein a drive gear device coupled to the rotation shaft of the oil pump is disposed between the partition wall and an internal wall of the oil pan.

* * * * *